US005428934A

United States Patent [19]

Tomek

[11] Patent Number: 5,428,934

[45] Date of Patent: Jul. 4, 1995

[54] INTERLOCKING SLAB ELEMENTS

[76] Inventor: Debby E. Tomek, 425 Claremont Way, Menlo Park, Calif. 94025

[21] Appl. No.: 157,317

[22] Filed: Nov. 26, 1993

[51] Int. Cl.[6] ..... E01C 5/00

[52] U.S. Cl. ..... 52/608; 52/604; 52/596; 404/41; 404/39

[58] Field of Search ..... 52/604, 608 OR, 596; 404/41, 38, 39

[56] References Cited

U.S. PATENT DOCUMENTS

| | | | |
|---|---|---|---|
| D. 42,404 | | | |
| D. 42,405 | | | |
| 400,974 | 4/1889 | Thorn . | |
| 474,339 | 5/1892 | Graham . | |
| 1,595,686 | 8/1926 | Perry . | |
| 2,323,848 | 7/1943 | Schaeffer . | |
| 2,340,526 | 2/1944 | Green . | |
| 2,919,634 | 1/1960 | Ploetner . | |
| 3,923,410 | 12/1975 | Jordan et al. | 52/604 X |
| 3,947,192 | 3/1976 | Rosenberger | 52/604 X |
| 4,016,692 | 4/1977 | Jordan et al. | 52/604 X |
| 4,128,357 | 12/1978 | Barth et al. . | |
| 4,185,939 | 1/1980 | Barth et al. . | |
| 4,544,305 | 10/1985 | Hair . | |
| 4,834,575 | 5/1989 | Barth et al. . | |
| 4,973,192 | 11/1990 | Hair | 404/41 |
| 5,186,574 | 2/1993 | Tavares | 404/41 X |
| 5,277,514 | 1/1994 | Glickman | 404/41 |

FOREIGN PATENT DOCUMENTS

| | | | |
|---|---|---|---|
| 0814801 | 6/1937 | France | 52/604 |
| 0373044 | 7/1939 | Italy | 404/41 |
| 0669816 | 4/1989 | Switzerland | 404/41 |
| 0000732 | 10/1911 | United Kingdom | 404/41 |

*Primary Examiner*—Carl D. Friedman
*Assistant Examiner*—Wynn E. Wood
*Attorney, Agent, or Firm*—Paul F. Schenck

[57] ABSTRACT

A surface covering slab element with a unique shape which has a combination of straight edges and complementary concave and convex edges. Numerous slab elements of this shape can be assembled in a variety of different ways for generating circular, straight and curved patterns with interfacing edges for connecting curved patterns to straight patterns.

4 Claims, 10 Drawing Sheets

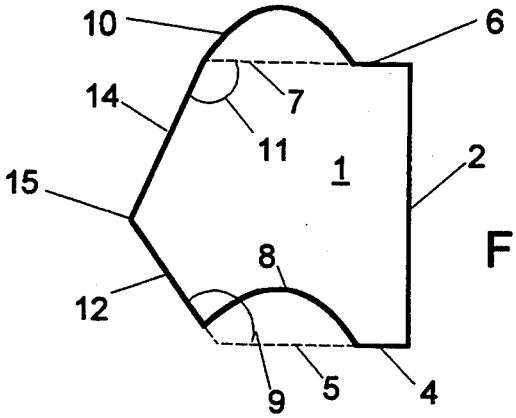
FIG. 1A
FIG. 1B
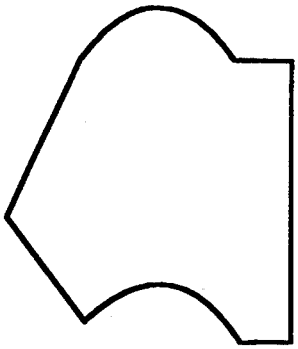
FIG. 1C
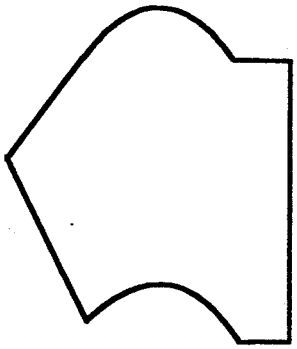
FIG. 1D
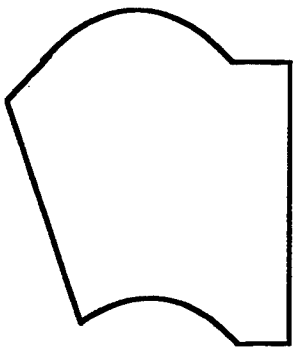
FIG. 2A
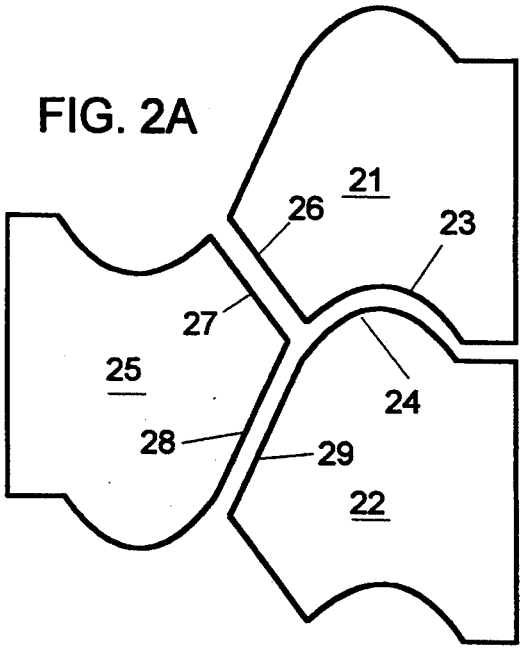

INTERLOCKING SLAB ELEMENTS

BACKGROUND OF THE INVENTION

The present invention relates to the improvement of covering natural and finished surfaces in an aesthetic manner with an irregular shaped element composed of a combination of angles and curved and straight edges. The shape of the elements allows interlocking when the elements are placed next to each other, and provide for a great number of configurations using elements with the mirror image in combination with elements of the first image. The shape allows interlocking at curved and straight edges. The element has interface capabilities allowing for repetitive non-rigid, curved or circular patterns and straight patterns having combined geometric peripheral shapes. The elements of the present invention have the capability for going around vertical or horizontal corners and into them as well. The overall size may vary according to application. The material used for these elements may be any that are currently used to cover vertical or horizontal natural and finished surfaces. The edge of these elements may be chamfered, bull-nosed, grooved, rabetted or finished according to application requirements. The spaces between adjacent elements may be filled with material or left open. The applications of the elements of this invention are varied according to the material used to produce the shaped elements. Applications are in the industrial, municipal, institutional, residential and commercial field. This element affords the user an opportunity for creating a total theme over a large area such as an open space park with a non-rigid format. Proper combination of these elements allow to combine straight or meandering pathways with different types of circular configurations embedding trees, fountains or flower beds. The arrangement of the elements allows for spaces to allow water to seep into the ground below, thereby preventing the ground water level to drop because there is a covered area.

In other applications the gap between adjacent elements can be filled with grout or other filler material where total coverage of a surface is required, such as in bathroom or kitchen areas.

On a smaller scale version the elements may be used in combination with other elements as tiles for countertop, wall and floor applications.

OBJECTS OF THE INVENTION

It is an object of the invention to provide for an interlocking slab element for covering natural or finished surfaces.

It is another object of the invention to provide for a slab element having angles and curves, and whose mirror image increases interlocking combinations.

It is still another object of this invention to provide for an interlocking slab element which allows to generate waving patterns, still providing straight lines edges.

It is another object of this invention to provide for an interlocking slab element which allows to generate circular as well as straight patterns.

The design of the present invention allows to make straight as well as circular arrangements. The selection of different orientations of adjacent slab elements provide a secondary pattern by the inter-slab gaps.

It is still another object of the present invention to provide for a slab element for covering ground in straight, meandering an circular patterns.

SHORT DESCRIPTION OF THE INVENTION

The interlocking slab element of the present invention is a modified five-sided element in which one of two parallel opposing sides includes a concave curved section, the other opposing side having a convex curved section. Concave and convex curved sections are complementary in that the convex curve and the concave curve are parallel if one slab element is placed with the convex curved section reaching into the recessed part of the concave curved section of the adjacent slab element. Depending on the particular application the parallelism of concave and convex curves includes a predetermined spacing of the slabs.

The two parallel sides are linked by a straight edged base border intersecting each of the parallel sides at right angles. Opposite to the base border there are two straight edged side borders of unequal length. The two side borders meet under an angle which matches the angle between side borders of adjacent slab elements.

The arrangement of curved sections allow to provide arrangements with waving patterns reaching in the direction of the parallel sides of the slab element. In another arrangement the waving pattern is combined with the side borders pointing at each other. Still in another arrangement slabs may be placed adjacent to each other with opposing corresponding edges, thereby generating a waving pathway.

The slab element of the present invention can be arranged in linear patterns for a pathway, circular patterns for surrounding an object or area, meandering patterns for garden arrangements and combinations of these patterns. Depending upon the application the linear arrangements may have straight line edges or patterned edges.

As indicated above, in a smaller scale the elements may be used for tiling of countertops, floors and walls in a similar way.

A variety of combinations are disclosed in combination with the description of the preferred embodiment.

SHORT DESCRIPTION OF THE FIGURES

FIG. 1A an illustration of the shape of the slab element.

FIG. 1B is an illustration of the basic configuration of the slab element of the present invention.

FIGS. 1C–1D are illustrations of slab element with modified shapes.

FIG. 2 is an illustration of a pattern of interrelating some of the edges of adjacently placed slab elements.

Figure 7A:
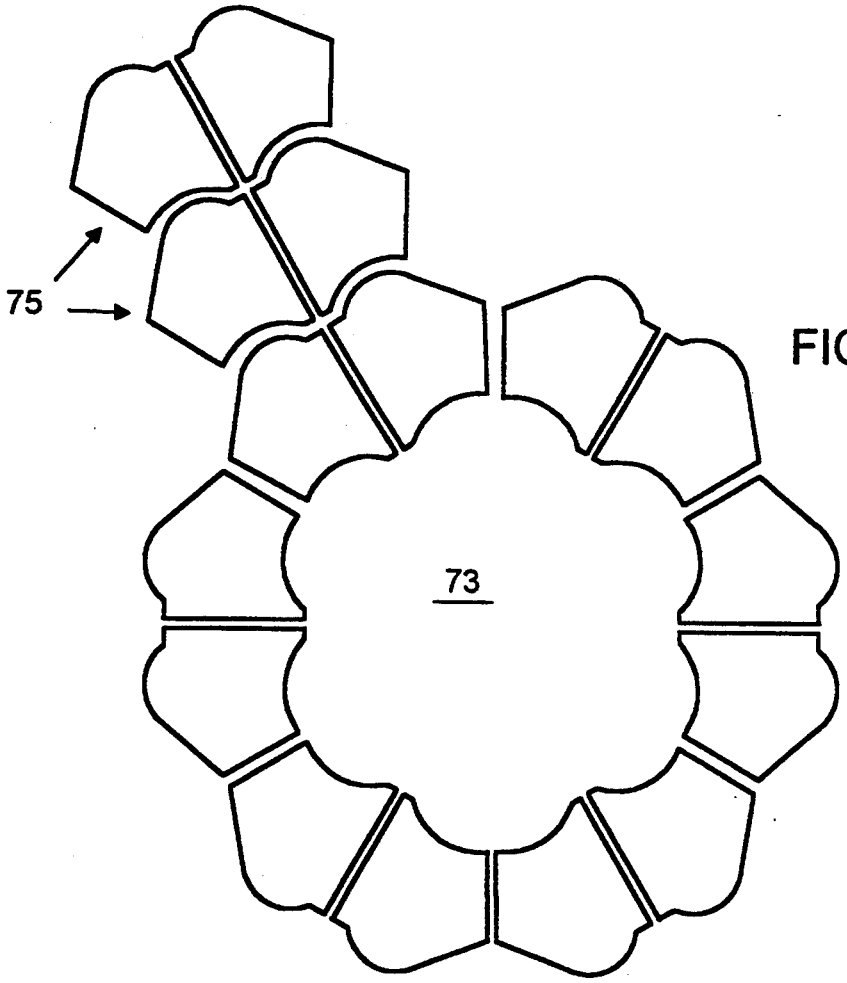
FIGS. 7A and 7B are illustrations of circular arrangements of a plurality of slab element of the present invention with connections to radial paths. The slab elements are placed with the concave curved section and the convex curved section at the outside edge of the circular arrangements, respectively.
Figure 7B:
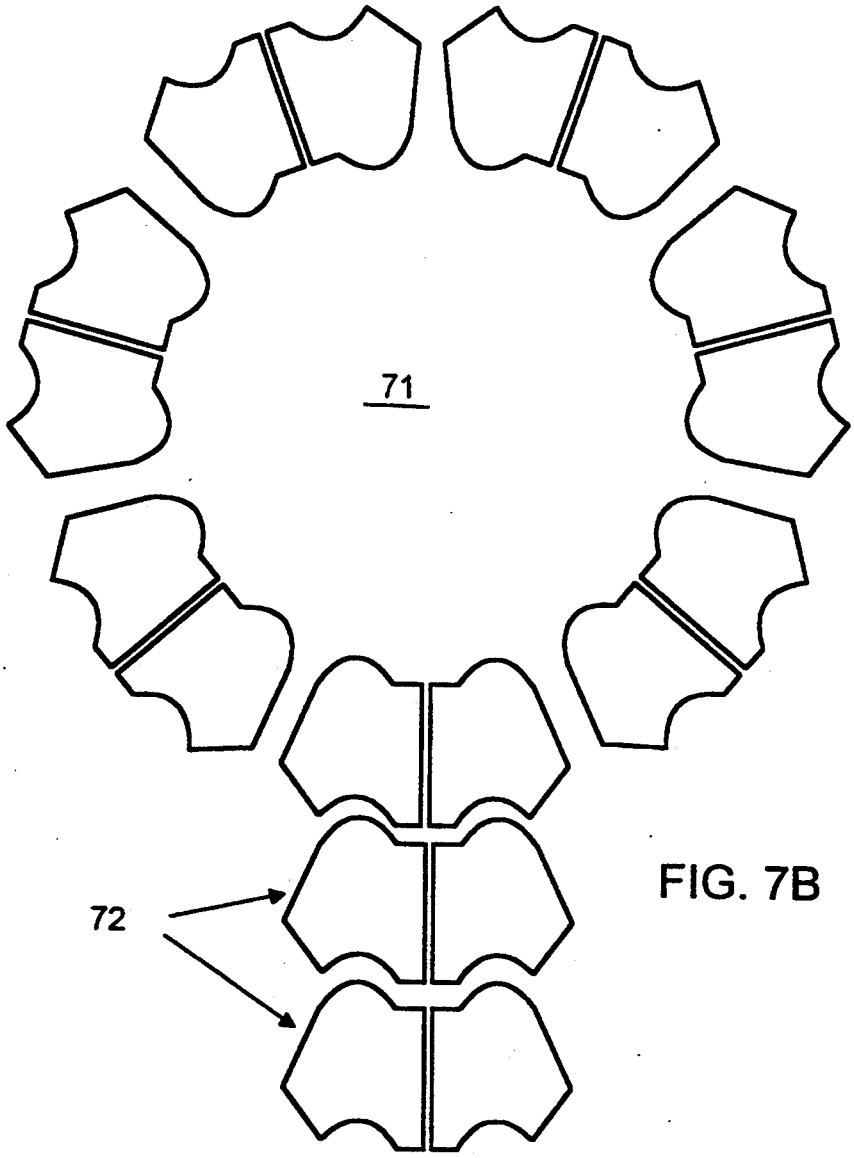
Figure 7C:
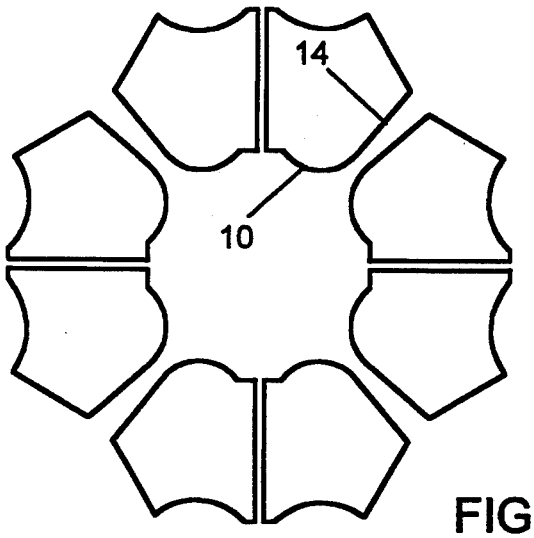
Figure 7D:
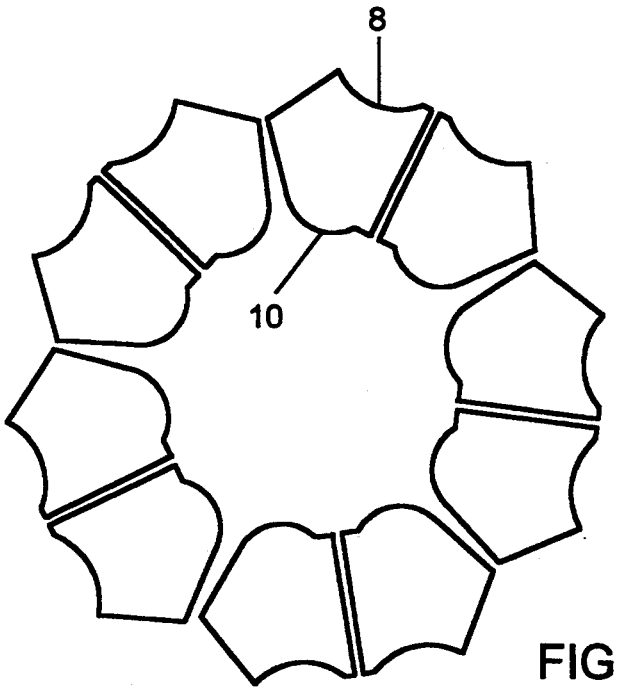

FIGS 7C and 7D and are illustrations of different circular arrangements of slab element of the present invention.

DESCRIPTION OF THE PREFERRED EMBODIMENT

FIG. 1A is an illustration of one configuration of the slab element of the present invention. Slab Element 1 has a straight edged base border 2. A short straight edged side border 4 and a short straight edged side border 6 connect to opposite ends of base border 2 at right angles. Side borders 4 and 6 are parallel to each other. Side border 4 continuous into concave curved border edge 8. Side border 6 continuous into convex curved border edge 10. Convex border edge 10 and concave curved border edge 8 are complementary in that their curvatures have the same characteristics.

Two straight border edges 12 and 14 complete the circumference of slab element 1. Border edges 12 and 14 may be of different lengths. Border edge 14 meets convex curved border edge 10 as a tangent at the end of border edge 10, thereby providing for a smooth transition from curved border edge 10 into straight border edge 14.

To provide spacing for grout, soil or sand between adjacent slab elements, border edges 4 and 6 are of different length, border edge 6 being longer than border edge 4. For the same reason concave curved border edge 8 is larger than convex curved border edge 10.

Depending upon the artistic impression to be supported the angle under which the curved section edges 8 and 10 meet parallel straight border edges 4 and 6, respectively, can be anywhere between 0 and 90 degree. The characteristics of the curvatures of border edges 8 and 10 can be strictly mathematical, such as arcs of circles, parabolic, hyperbolic, or free-hand, or even multiple straight lines substituting smooth curvatures. Extensions of border edges 4 and 6 are shown in FIG. 1A as dashed lines 5 and 7. Extension 7 meets straight edge section 14 at an angle 11. Extension 5 meets the extension of straight edge section 12 at an angle 9. Angle 9 determines the number of tightly arranged slab elements in a first circular arrangement, in which the convex curved sections are at the outer circumference. Angle 11 determines the number of tightly arranged slab elements in a second circular arrangement, in which the concave curved sections are at the outer circumference.

By placing straight edge section 12 more inwardly than shown in FIG. 1A point 15 of slab element can be placed closer to convex curved edge 10, thereby changing the contour of slab element 1.

FIGS. 1B, 1C and 1D are slab elements the same curvatures at edges 8 and 10, but differently placed edge 12.

Figure 2B:
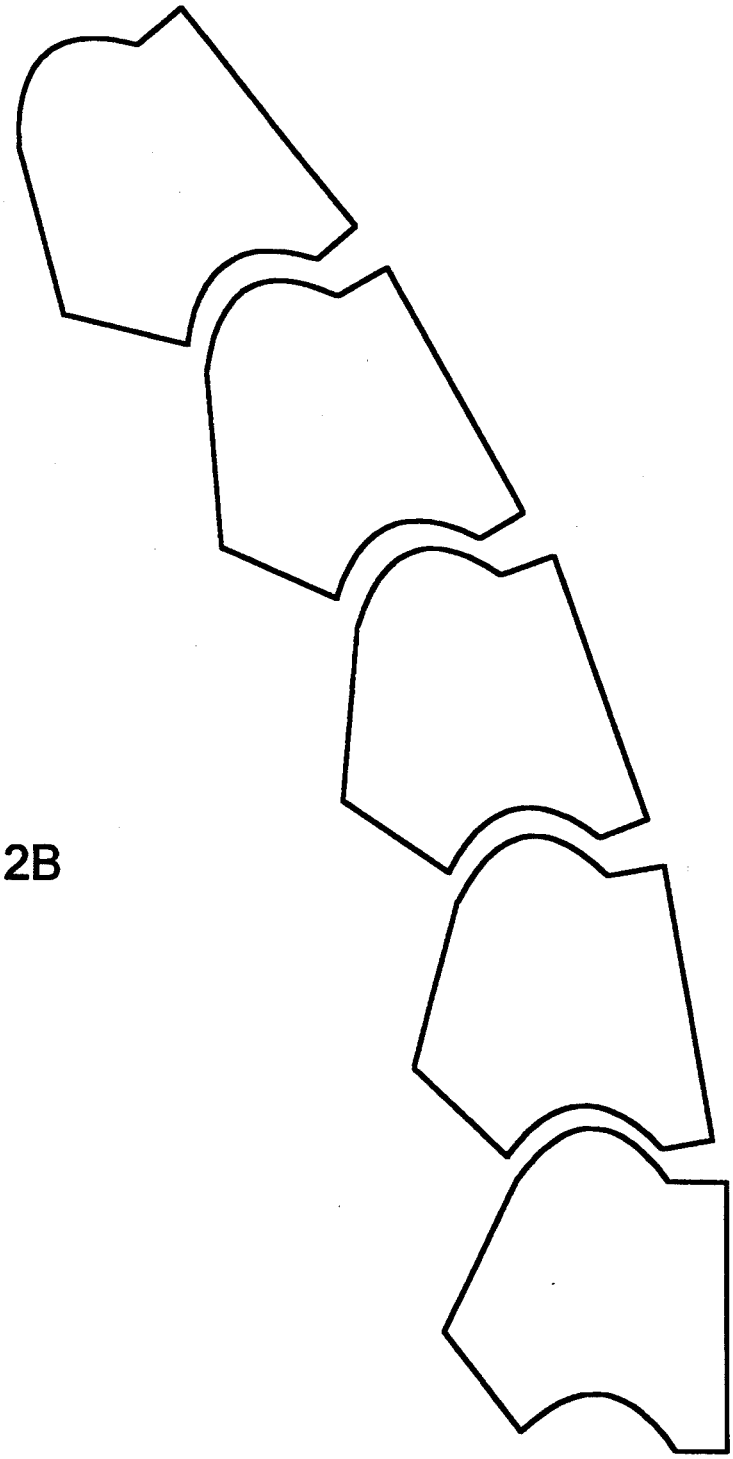
FIG. 2B is an illustration of a curved arrangement of slab elements.

FIG. 2 is an illustration of a pattern interrelating the curved section edges and straight section edges of adjacently placed slab elements. The two slab elements 21 and 22 interface with concave and convex curved edges 23 and 24. If the curvatures are circular arcs then slabs 21 and 22 can be angled to generate a bend or part of a circular arrangement. It is obvious that the desired grout gap or spacing between adjacent slabs determines the difference between the concave border edge and the concave border edge.

Slabs 21 and 25 interface on the straight border edges 26 and 27, respectively. Slabs 22 and 25 interface on straight border edges 28 and 29, respectively.

Figure 3A:
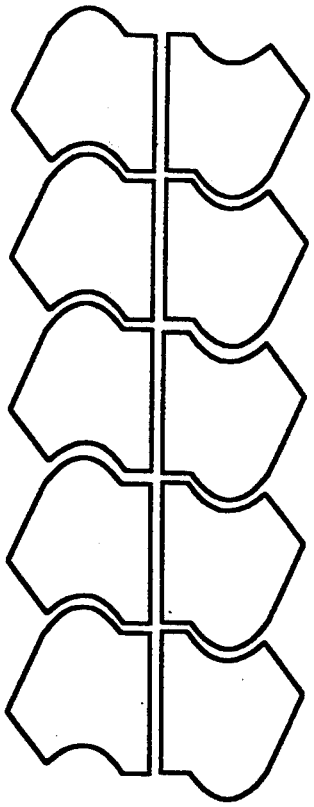
FIGS. 3A and 3B are illustrations of double row arrangements of slab elements of the present invention.
Figure 3B:
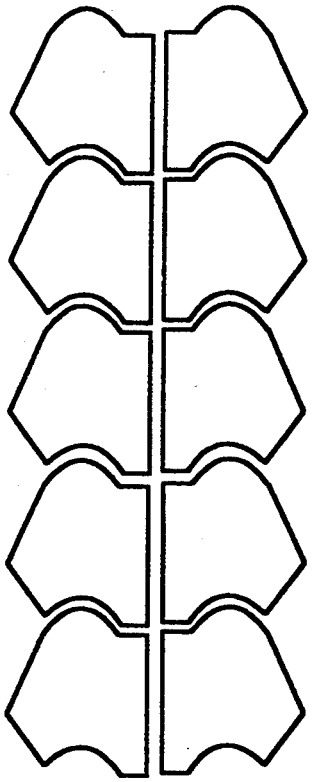

FIGS. 3A and 3B are illustrations of dual row arrangements with aligned edges 2 as the center axis of the pattern arrangements. The patterns of FIG. 3A provides a wavy form, the pattern of FIG. 3B gives a bat-like impression. The pattern of FIG. 3B requires mirror image slabs or slabs which can be used face-up or face-down.

Figure 4A:
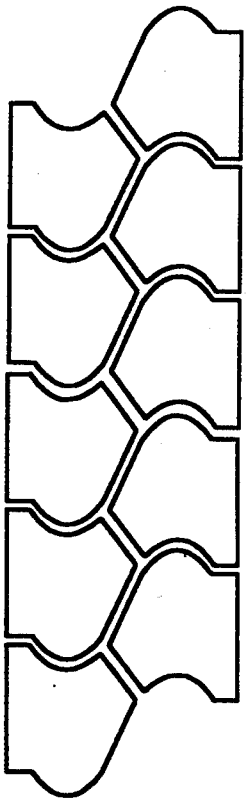
FIGS. 4A, 4B and 4C are illustrations for double row arrangements of slab elements with straight outside edges of the arrangements.
Figure 4B:
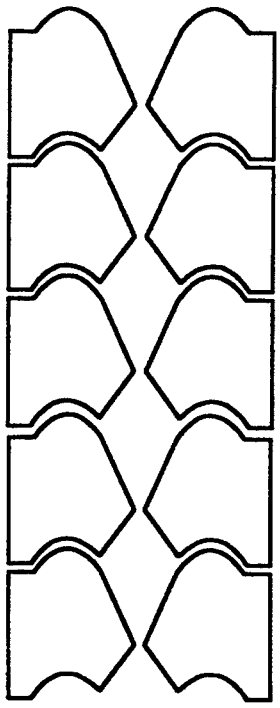
Figure 4C:
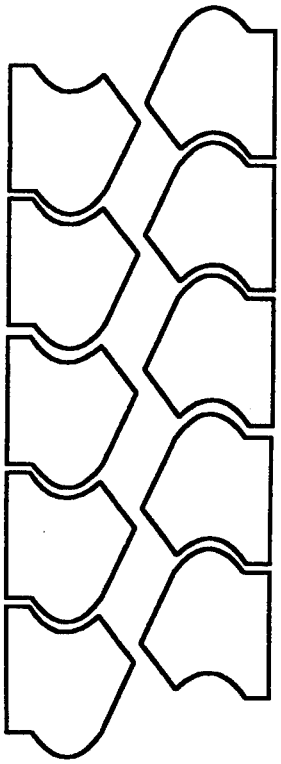

FIGS. 4A, 4B and 4C are illustrations of dual row arrangements with aligned edges 2 providing straight outer borders. The pattern of FIG. 4A includes a large wave between the left and the right outer border edges. In FIG. 4C the slab element rows are spaced and off-set to provide an opening along the center axis. FIG. 4B is a dual row pattern with mirror image slab elements and spaces along the center axis. Depending upon the artistic impression to be generated the openings along the center axis may remain open for growing grass or the like, or can be filled with sand or appropriately shaped other slab elements.

Figure 5A:
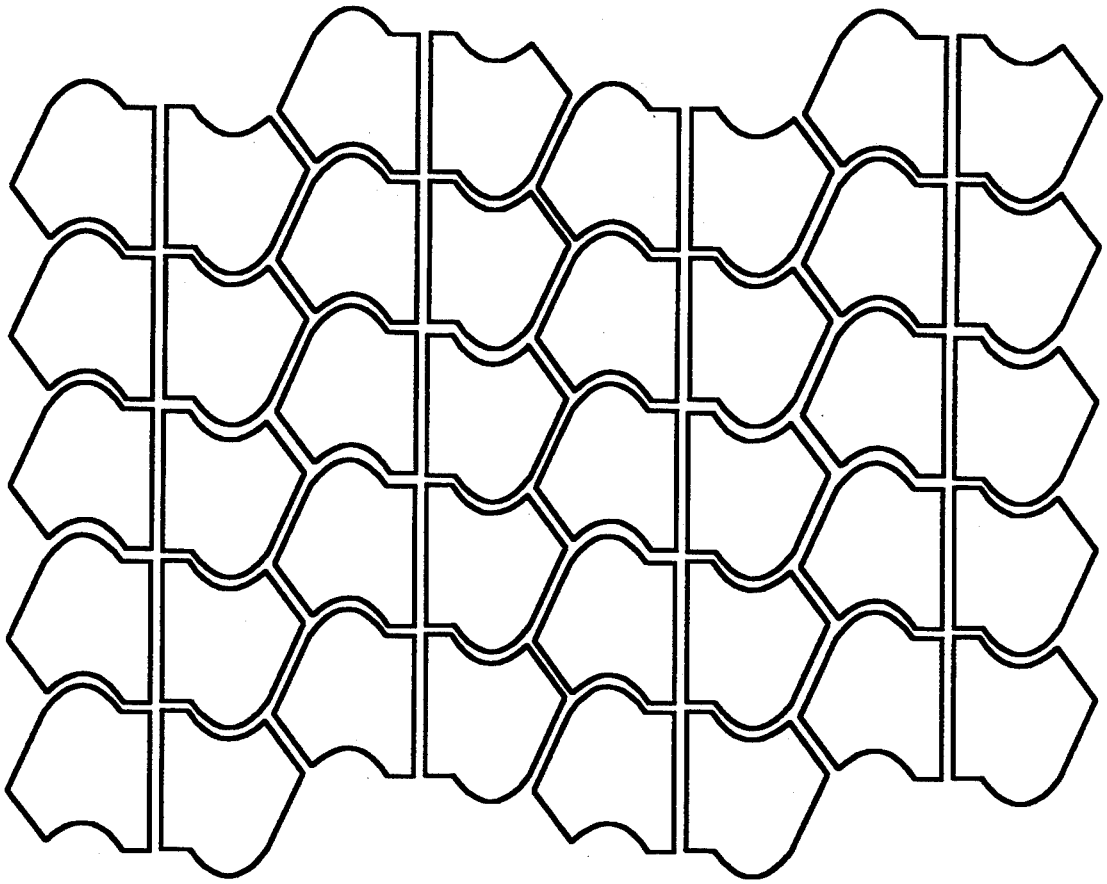
FIGS. 5A and 5B are illustrations of arrangements of four double rows of slab elements.
Figure 5B:
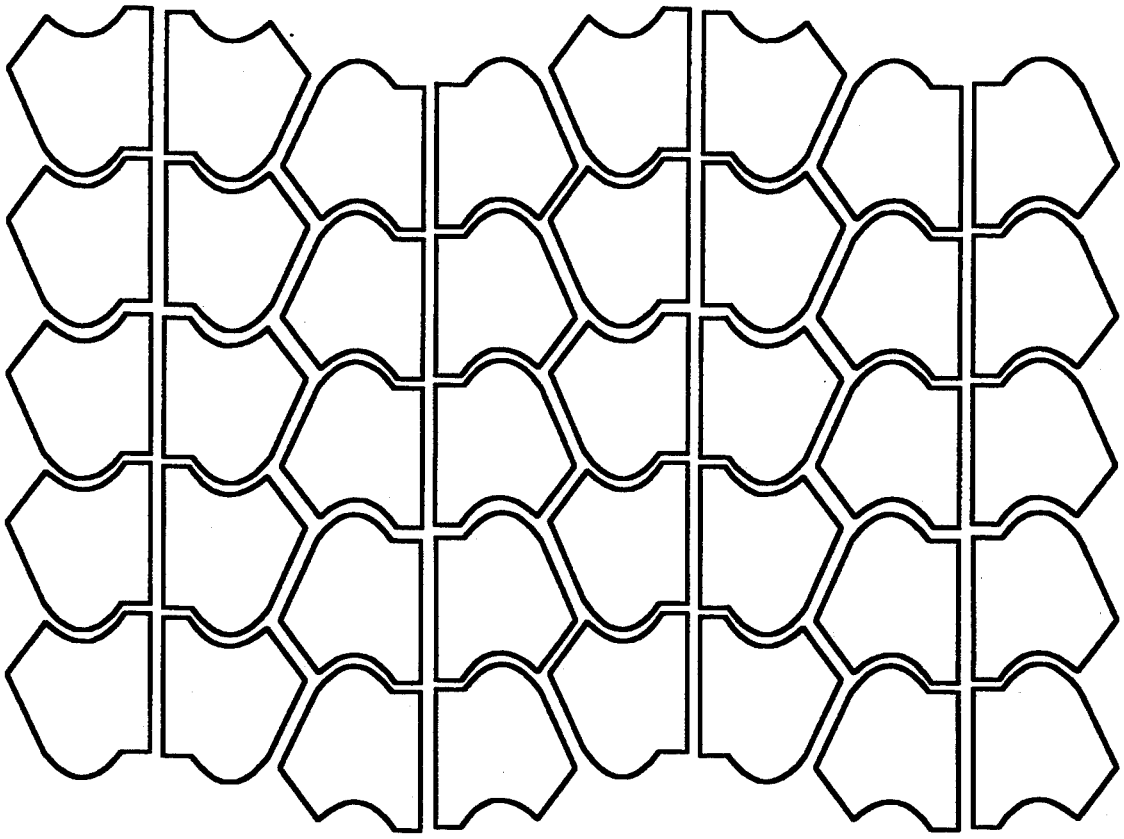

FIG. 5A is a wider pathway pattern with three columns of the pattern of FIG. 3A. FIG. 5B is a wider pathway pattern using the bat-like pattern. Both type of pathway patterns can be used with the major straight section patterns in the direction of the pathway or across the pathway. In the latter case the pathways exhibit a slight meandering characteristic.

Figure 6A:
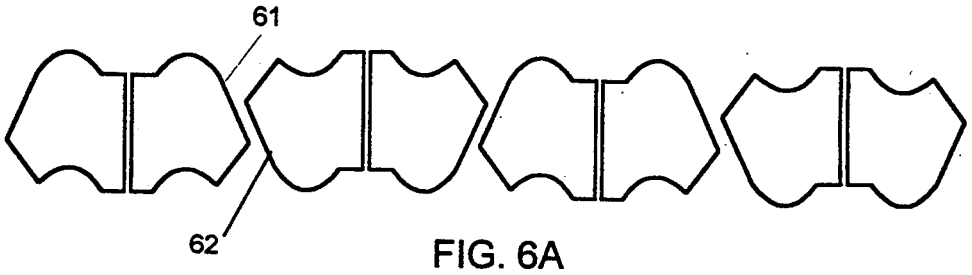
FIGS. 6A, 6B and 6C are illustrations of other single row and double row arrangements using slab elements of the present invention.
Figure 6B:
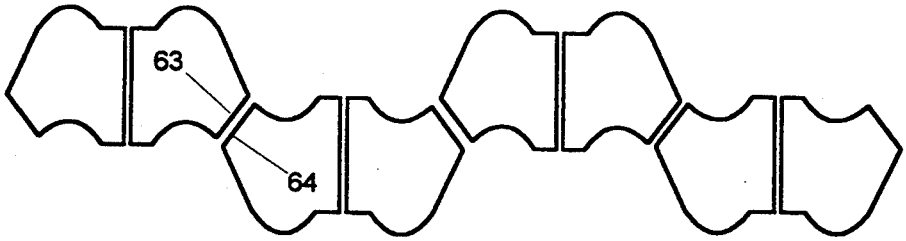
Figure 6C:
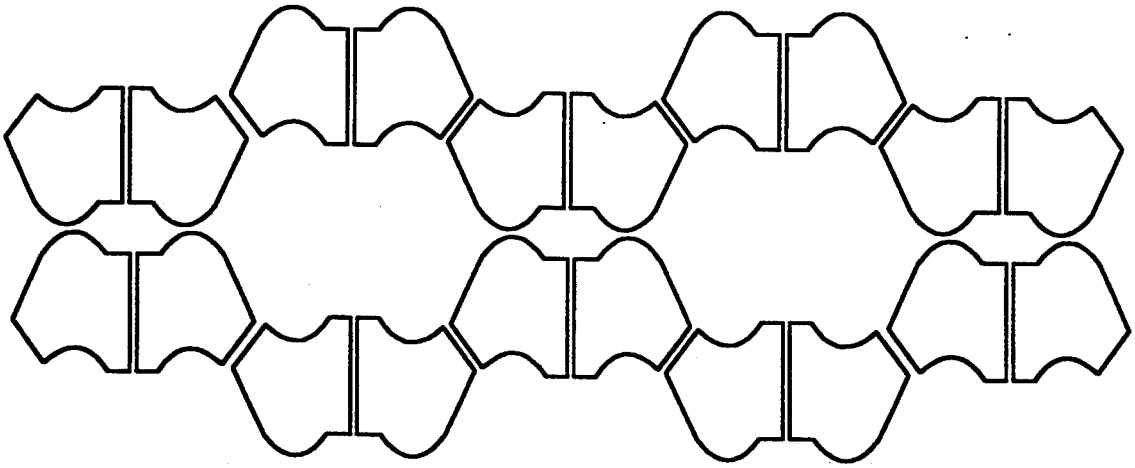

FIG. 6A is an illustration of a narrow, meandering arrangement of slab elements of the present invention. This pattern uses the slab elements in pairs. Adjacent pairs meet with borders 61 and 62. The angled borders 61 and 62 provide for easy adjustment of the slabs to the length of the pathway to be provided. FIG. 6B is another narrow meandering arrangement in which short sides 63 and 64 can be used for slight pathway length adjustments. FIG. 6C is an illustration of a dual row meandering arrangement using the pattern of FIG. 6B.

FIG. 7A is an illustration of a first circular arrangement 73 of slab elements of the present invention. Arrangement 73 can be combined with patterns 75 to provide for e.g. a straight walkway to circular arrangement 73. In FIG. 7A the concave curved border edges of the slab elements are on the inner side of the circular arrangement.

FIG. 7B is an illustration of a second circular arrangement of slab elements of the present invention. The circular arrangement 71 allows for an easy combination with a plurality of patterns 72 to provide for e.g. straight walkways to arrangement 71. In FIG. 7B the convex curved border edges of the slab elements are on the inner side of the circular arrangement.

FIGS. 7C and 7D are examples of arrangements in which the grout gap between adjacent slab elements is not kept constant. Such arrangements allow to adjust the size of a circular arrangement to ta desired diameter or to enclose a certain object. The use of uneven spacing between adjacent slab elements does not disturb the artistic impression because of the arrangement of the tangential intersection of edges 10 and 14.

As can be recognized from the various patterns the waviness of the inner and outer edges of patterns can be influenced by the selected concave and convex curved sections 8 and 10. Flat curved sections generate a smooth wave, steep curved sections generate a strong waviness.

What I claim is:

1. A surface covering slab element comprising a pentagonal plate having a first edge with a partial convex edge section and a second edge with a partially concave edge section, said concave section and said convex section having complementary curvatures.

2. A surface covering slab element comprising a plate having five straight edge sections and two curved edge sections, two of said five straight edge sections being connected to right angles to the ends of a third one of said five straight edge sections;

said two of said five straight edge sections being connected to one end of a concave and a convex curved edge section respectively, two remaining straight edge sections being connected at one end to the other ends of said curved edge sections respectively, the second ends of the two remaining straight edge sections meeting at a first angle;

said two remaining straight edge sections or extensions of said two remaining straight edge sections meeting extensions of said two of said five straight edge sections under second and third angles, said second and third angles determining the number of said slab elements arrangeable in circular arrangements with equally spaced inter-slab spacing.

3. A surface covering slab element comprising a plate having five straight edge sections and two curved edge sections, a first and a second straight edge section being arranged at right angles each to one of two ends of a third one of said five straight edge sections;

said first and second straight edge sections being connected to one end of a concave edge section and a convex edge section, respectively;

fourth and fifth straight edge sections being connected at one end to the other ends of said curved edge sections, respectively, the second ends of the fourth and fifth straight edge sections meeting at a first angle;

said fourth and fifth straight edge sections or extensions of said fourth and fifth straight edge sections meeting extensions of said first and second edge sections under a second and a third angle respectively, said second and said third angles determining the number of slab elements being arrangeable in a circular arrangement with equal inter-slab space.

4. A surface covering slab element as claimed in claim 3, wherein said second angle determines the number of slab elements in a first circular arrangement, and wherein said third angle determines the number of slab elements in a second circular arrangement.

* * * * *